United States Patent [19]

Kasai et al.

[11] 4,342,430

[45] Aug. 3, 1982

[54] METHOD OF SHIFTING STRANDS BEFORE TERMINATION OF WINDING OF GLASS FIBER

[75] Inventors: Sin Kasai; Yutaka Kawaguchi; Michio Satoh, all of Fukushima, Japan

[73] Assignee: Nitto Boseki Co., Ltd., Fukushima, Japan

[21] Appl. No.: 152,366

[22] Filed: May 22, 1980

[30] Foreign Application Priority Data

May 28, 1979 [JP] Japan ..... 54/65760
Aug. 17, 1979 [JP] Japan ..... 54/104105

[51] Int. Cl.[3] ..... B65H 54/02; B65H 67/04

[52] U.S. Cl. ..... 242/18 A; 242/18 G; 242/18 PW; 242/35.5 R

[58] Field of Search ..... 242/18 A, 18 G, 18 PW, 242/35.5 R

[56] References Cited

U.S. PATENT DOCUMENTS 4,057,195 11/1977 Jones et al. ..... 242/18 A X

*Primary Examiner*—Stanley N. Gilreath

*Attorney, Agent, or Firm*—Norbert P. Holler; Charles A. Blank

[57] ABSTRACT

In drawing glass fiber from a glass melting furnace to form a multiplicity of filaments which are first divided and formed into a plurality of strands which are then wound on a single spindle to form a plurality of square-ended packages thereon, the strands are shifted to a front waste take-up portion of the spindle by means of a guide which is moved from the rear end to the front end of the spindle across the paths of movements of the strands when the packages are fully wound, to enable the fully wound spindle to be replaced by a new spindle without interrupting the drawing of glass fiber. The spacing between the spindle and the path of travel of the guide and the speed of travel of the guide are set at a low level and a high level respectively which are sufficient to ensure at least loose portions of the strands, which are produced when they drop into the groove between the adjacent packages, to be immediately wound on the peripheral surface of the adjacent package.

2 Claims, 8 Drawing Figures

METHOD OF SHIFTING STRANDS BEFORE TERMINATION OF WINDING OF GLASS FIBER

BACKGROUND OF THE INVENTION

This invention relates to a method of shifting strands to a front waste take-up portion at the front end of a spindle when the spindle is fully wound in the production of glass fiber which method is suitable for use in carrying into practice a method of drawing a multiplicity of filaments from a glass melting furnace, dividing them into a plurality of strands and winding such strands on a single spindle to form a plurality of square-ended packages thereon.

Nowadays, the nozzle formed at the bottom of a bushing for drawing molten glass as filaments in producing glass fiber has as much as several thousand holes. The filaments drawn from such nozzle of a multiplicity of holes are divided and formed into a plurality of strands depending on the use to which the glass fiber is put. The strands are wound into a plurality of packages. In forming a plurality of packages, to simplify the equipment, a plurality of strands are wound on a single spindle of a take-up device to form a plurality of packages thereon. Typical packages formed in this way include double-tapered packages and square-ended packages.

In forming a plurality of packages on a single spindle, the spindle that has been fully wound should be replaced by a new spindle. In effecting spindle replacements, the following steps are generally followed. First, all the strands are temporarily shifted to the front waste take-up portion at the front end of the fully wound spindle and then shifted to and wound on a strand transfer drum moved close to the front waste take-up portion. During this process, the fully wound spindle is replaced by a new spindle, and the strands are shifted again to the front waste take-up portion of the new spindle following completion of switching of the spindles. Thereafter the strands are shifted back to their predetermined positions on the spindle. In this fashion, the fully wound spindle can be replaced by the new spindle without interrupting the movement of the strands or the operation of drawing glass fiber.

When the plurality of packages formed on a single spindle are double-tapered packages, it is possible to shift the strands to the front waste take-up portion of the fully wound spindle merely by moving slowly the strands to be wound on the packages to the front end of the spindle by means of a shift guide. More specifically, since a double-tapered package has a tapered portion on either end of a cylindrical center portion, the strands intended for other packages can be shifted smoothly as they pass the tapered portion, cylindrical center portion and tapered portion in that order as the shift guide moves in the aforesaid direction, so that the strands can be shifted to the front end of the fully wound spindle without any trouble. However, when the packages formed on a single spindle are square-ended packages, difficulties have hitherto been encountered in shifting the strands to the front waste take-up portion of a fully wound spindle, due to the fact that a deep groove is defined between the adjacent packages on the spindle. It is impossible to shift the strands across each package merely by moving them transversely over each package because the strands drop into the groove. To cope with this situation, it has hitherto been necessary to temporarily shut off the take-up device and stop winding of the strands and, following replacing of the fully wound spindle by a new one, to align the filaments continuously drawn from the glass melting furnace and manually wind them on the front waste take-up portion of the new spindle, simply because of inability to shift the strands to the front waste take-up portion at the front end of the fully wound spindle. Such operation is not only troublesome but also time consuming. Thus the method of the prior art of replacing the fully wound spindle by a new one has had the disadvantage of causing a marked reduction in the operation efficiency of glass fiber drawing machines.

SUMMARY OF THE INVENTION

This invention has been developed for the purpose of obviating the aforesaid disadvantage of the prior art. Accordingly, the invention has as its object the provision of a method of shifting strands suitable for use in carrying into practice a method of winding strands on a single spindle to form a plurality of square-ended packages thereon, which method is capable of smoothly shifting the strands to a front waste take-up portion of the spindle when the packages are fully wound.

Research conducted by the inventors on shifting of the strands between the adjacent square-ended packages has revealed that even if a strand for one package drops into the groove between the adjacent packages, such strand is immediately brought into contact with and wound on the adjacent package when an angle at which the strands come into contact with the edge of the adjacent package is sufficiently large. The angle would be large if the spacing between the path of travel of the guide which engages the strand and shifts them over the packages and the spindle is small and also if the speed of travel of the guide is high. Thus when the spacing between the path of travel of the guide and the spindle is sufficiently small and the speed of travel of the guide is sufficiently high to enable the requirements to be met, it is possible to permit a loose portion of the strand, which is produced when the strand for one package drops into the groove between the adjacent packages, to be immediately brought into contact with and wound on the adjacent package. It has also been discovered that by further reducing the aforesaid spacing or increasing the speed of travel, it is possible to enable the strands to be immediately shifted to the adjacent package without dropping into the groove between the adjacent packages.

According to the invention, there is provided in a method of drawing a multiplicity of glass filaments from a glass melting furnace, dividing them into a plurality of strands and winding on a single spindle to form a plurality of square-ended packages thereon, a method of shifting strands when the spindle is fully wound characterized by a step of moving a guide from a rear end of the spindle toward a front end thereof across the path of movements of the strands to be wound on the spindle when the spindle is fully wound so that the guide successively collects and shifts the strands while moving toward the front end of the spindle, wherein the spacing between the path of travel of the guide and the spindle and the speed of travel of the guide are set at a low level and a high level respectively which are sufficient to enable at least loose portions of the strands produced when dropping into a groove formed between adjacent packages immediately to wind on the peripheral surface of the adjacent package, whereby the strands can be shifted to a front waste take-up portion of the spindle at the front end thereof.

BRIEF DESCRIPTION OF THE DRAWINGS

FIG. 4 being a schematic view of the spindle and FIG. 5 being a front view thereof.

DETAILED DESCRIPTION OF THE PREFERRED EMBODIMENTS

Figure 1:
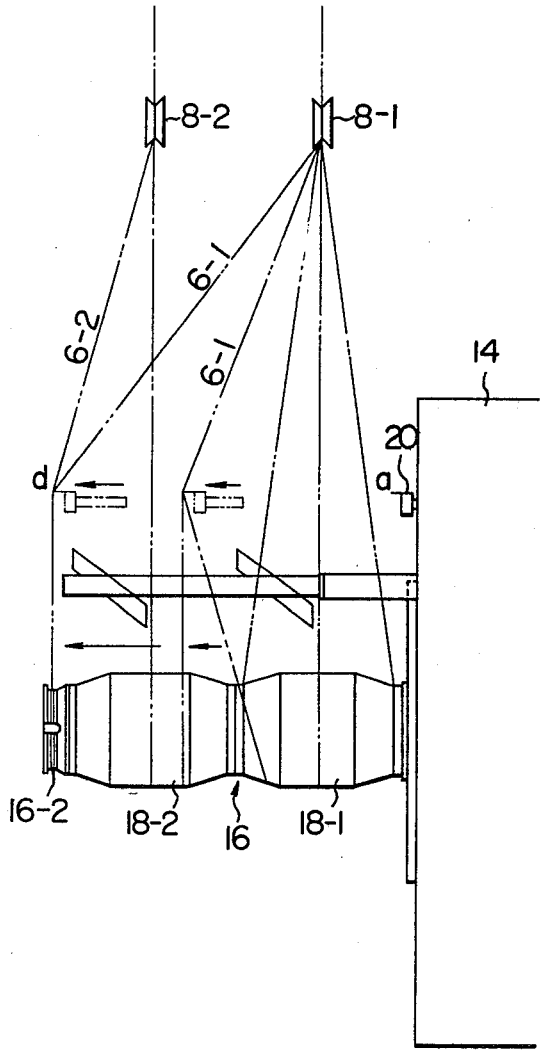
FIG. 1 is a schematic front view of a glass fiber winder in explanation of the manner in which strands are shifted when a plurality of double-tapered packages are formed on a single spindle.

To enable the present invention to be clearly understood, a method of shifting strands in forming double-tapered packages will be described in brief by referring to FIG. 1. A multiplicity of filaments are divided and formed by two shoes 8-1 and 8-2 into strands 6-1 and 6-2 respectively which are wound on a spindle 16 of a winder 14 to form two double-tapered packages 18-1 and 18-2 thereon. When the packages 18-1 and 18-2 are fully wound, a guide 20 is moved slowly from a position a to a position d across the paths of movements of the strands 6-1 and 6-2. As the guide 20 moves, it engages with and shifts the strands leftward, so that the positions in which the strands 6-1 and 6-2 are wound on the spindle 16 to form the packages gradually shift toward the front end of the spindle 16 until a front waste take-up portion 16-2 is reached. Since the double-tapered packages 18-1 and 18-2 each have a tapered portion on either end thereof, it is possible for the strands 6-1 and 6-2 to pass smoothly over the packages 18-1 and 18-2 as the guide 20 moves. Thus no trouble occurs. However, as described hereinabove, when a plurality of square-ended packages are formed on a single spindle, a deep groove is formed between the adjacent packages, so that it is impossible for the strands to shift their positions smoothly to the front waste take-up portion of the spindle while they are merely moved across the path of their movements from the shoes to the spindle by the guide, because the strands drop into the groove.

Figure 2:
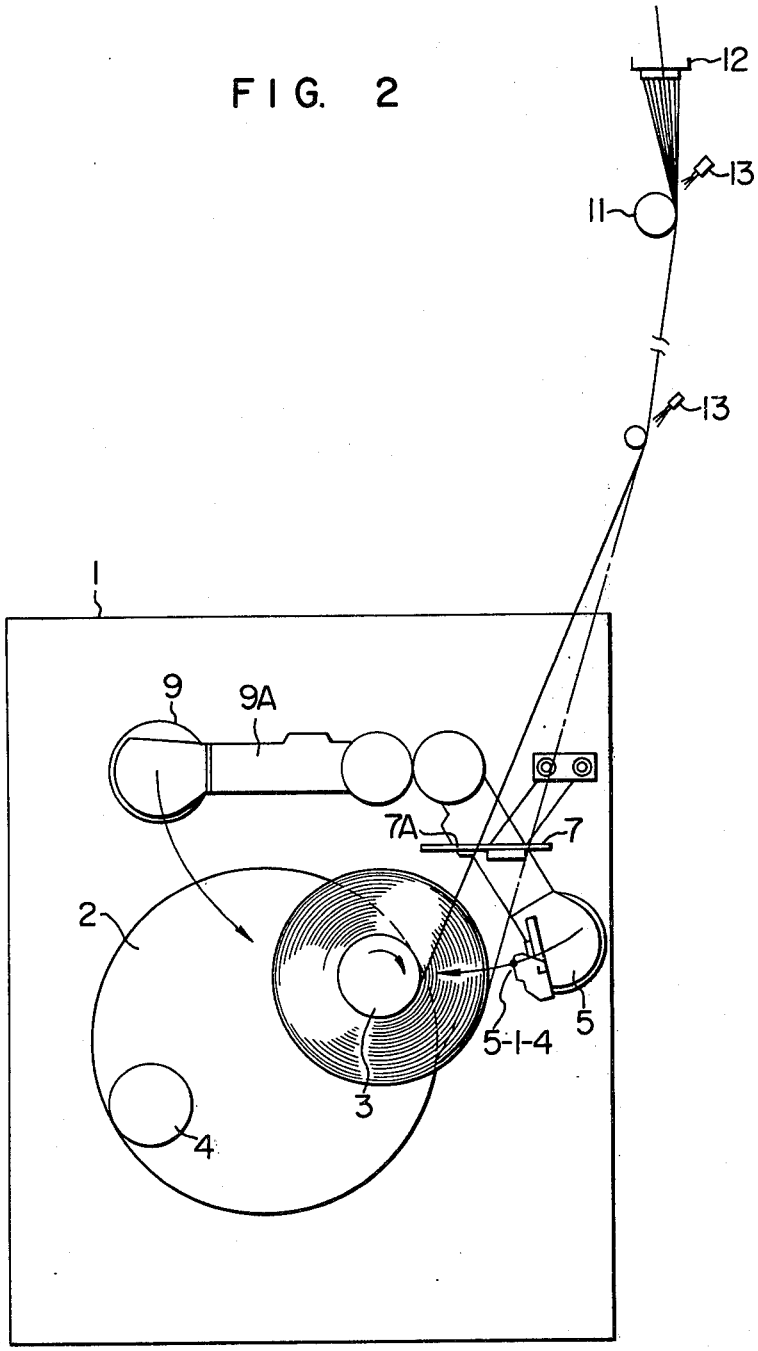
FIG. 2 is a schematic view of glass fiber producing apparatus including a winder suitable for carrying the method according to the invention into practice.
Figure 3:
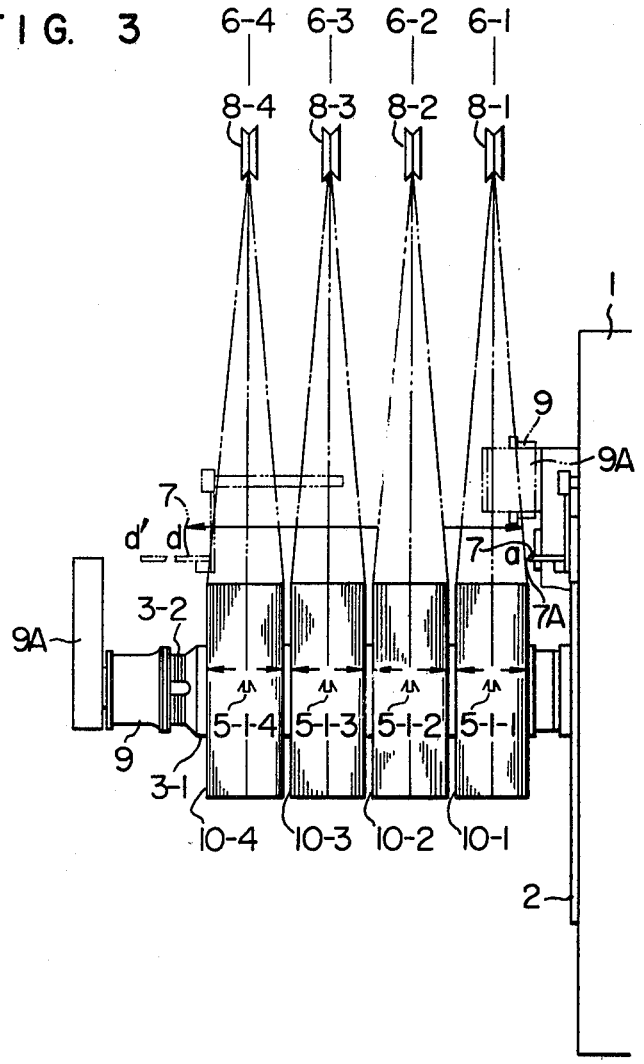
FIG. 3 is a front view of the winder shown in FIG. 2.

Preferred embodiments of the invention will now be described. In FIGS. 2 and 3, a glass fiber producing apparatus is shown in which a multiplicity of filaments drawn from a bushing 12 of a glass melting furnace are divided and formed by four shoes 8-1, 8-2, 8-3 and 8-4 into four strands 6-1, 6-2, 6-3 and 6-4 respectively which are wound on a spindle 3 of a turret type winder 1, to form four square-ended packages 10-1, 10-2, 10-3 and 10-4 thereon. The winder 1 includes a turret 2 having two spindles 3 and 4 and a traverse means 5 having four traversing guides 5-1-1, 5-1-2, 5-1-3 and 5-1-4. In addition, the winder 1 has a guide 7 which is supported so as to move in parallel with the axis of the spindle 3 across the paths of movements of the strands. The guide 7 has a strand engaging edge 7A of sufficient length so that as the guide 7 moves from a position a to a position d, the edge 7A engages with and shifts the strands. The guide 7 is connected to a suitable driving means (not shown) such as a penumatic or hydraulic cylinder means so as to be moved at a desired speed. The winder 1 further has a strand transfer drum 9 rotatably supported on a swing arm 9A. The swing arm 9A is linearly movable from a retracted position near the frame of the winder 1 to an extended position far from the frame and is pivotally movable from a position shown in FIG. 2 to a position in which the drum 9 is in align with the spindle 3 and contacts with the end face of the spindle 3, as shown in FIG. 3.

Prior to the description of the method of shifting strands according to the invention, operation of the glass fiber producing apparatus shown in the figures at initiation of winding will be described.

Glass fiber in the form of filaments drawn from the holes of the nozzle at the bottom of the bushing 12 is brought into contact with a dressing or size-applicator 11 and cooled by spraying at 13 into strands which are led to the shoes 8-1, 8-2, 8-3 and 8-4 and divided into the strands 6-1, 6-2, 6-3 and 6-4. The strands are guided by the guide 7 stopping in the position d and wound on a front waste take-up portion 3-2 of the spindle 3. At this time, the traversing means 5 is disposed in a position in which it is spaced apart from a take-up portion 3-1 of the spindle 3. When the strands wound on the front waste portion 3-2 attain a predetermined diameter, the guide 7 is moved from position d to position a. As a result, the strands divided and formed by the shoes 8-1, 8-2, 8-3 and 8-4 move to positions on the take-up portion 3-1 of the spindle 3 which are commensurate with the positions of the respective shoes. At this time, the traversing means 5 is activated and moved toward the take-up portion 3-1 of the spindle 3. This permits the strands 6-1, 6-2, 6-3 and 6-4 to be inserted in a groove of traversing guides 5-1-1, 5-1-2, 5-1-3 and 5-1-4 respectively, so that traversing is effected in discrete positions on the take-up portion while the strands are held in the grooves, to thereby form the packages 10-1, 10-2, 10-3 and 10-4. That is, the strand 6-1 passing through the shoe 8-1 is formed into the package 10-1 by the traversing guide 5-1-1. In this way, the strands are formed into the respective packages by the respective shoes and traversing guides, so that a plurality of packages can be formed on the take-up portion 3-1 of the spindle 3. By moving the traversing means 5 in a manner to follow up the growth of the packages, the square-ended packages can be formed.

The process for replacing the spindle 3 by a new one when the packages formed on the spindle 3 are fully wound will be described. Moving the traversing means 5 away from the packages releases the strands from the traversing guides, so that each strand moves to a position on the associated package which is regulated by the respective shoe and is freed from traversing. Then the guide 7 is moved from position a to position d across the paths of movements of the strands to let the strands negotiate the grooves between the adjacent square-ended packages and be formed into a bundle, until the strands reach the front waste take-up portion 3-2. This shifting movement of the strands is subsequently to be described in detail. When all the strands have moved to the front waste take-up portion 3-2 of the spindle 3 to be wound thereon, the guide 7 is further moved to a position d'. By this time. the strand transfer drum 9 has been brought, as shown in FIG. 3, to a position adjacent to the front end of the spindle 3 for coaxial frictional rotation with the spindle 3. Thus the strands are all transferred to the strand transfer drum 9 from the spindle 3. After the strands have moved to the strand transfer drum 9, the turret 2 is rotated to replace the fully wound spindle 3 by the new spindle 4 which is arranged in a predetermined winding position. Upon completion of this spindle replacing operation, the guide 7 is returned from position d' to position a, to thereby allow the strands to be wound on the strand transfer drum 9 to move to the new spindle 4. Thus another plurality of square-ended packages are formed on the spindle 4 by the action of the winding device described hereinabove in a continous winding of the square-ended packages without interruption of operation.

In the process described hereinabove, when the strands 6-1, 6-2, 6-3 and 6-4 are shifted to the front waste take-up portion 3-2, each strand should negotiate the deep groove between the adjacent packages. If any strand is unable to negotiate the groove and drops thereinto, the edges of the packages would be damaged and strand breakout would occur. This invention provides a method which enables each strand to smoothly negotiate the groove between the adjacent packages. The process in which each strand successively negotiates the groove between the adjacent packages in shifting its positions toward the front end of the spindle according to the method of the invention will be described by referring to FIGS. 4 and 5.

Figure 5:
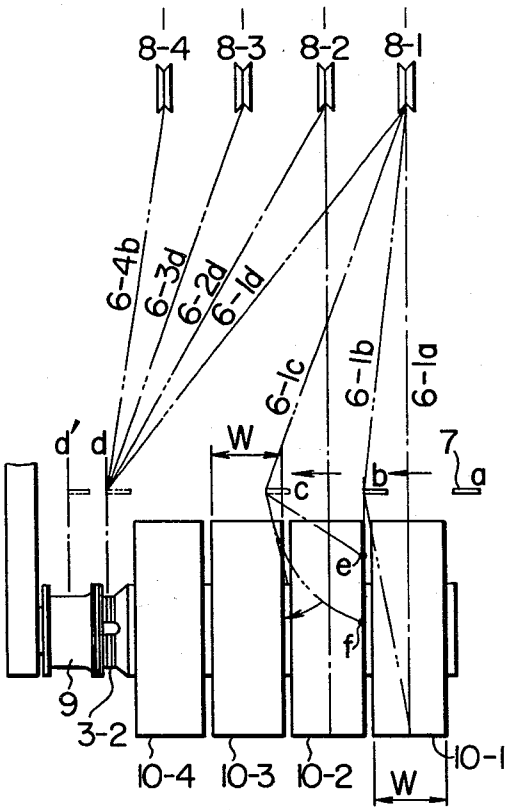
FIGS. 4 and 5 are views in explanation of the manner in which the strands shift their positions by negotiating the groove between the adjacent packages according to the method of the invention.
Figure 4:
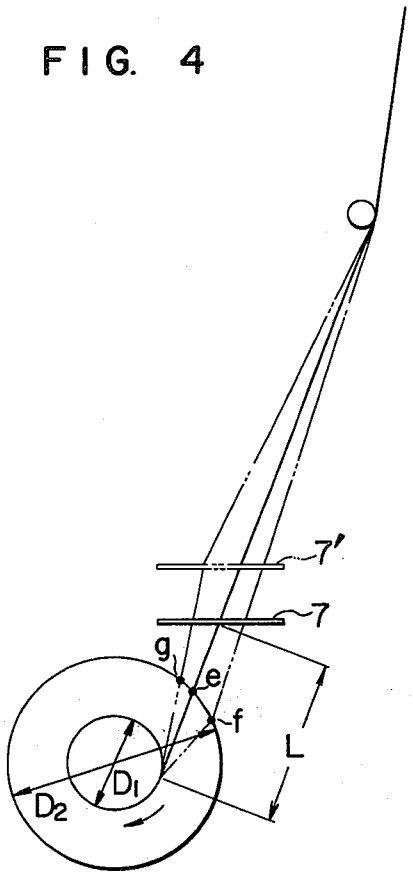

In FIGS. 4 and 5, the strands 6-1, 6-2, 6-3 and 6-4 pass through the shoes 8-1, 8-2, 8-3 and 8-4 to be wound on the surfaces of the packages 10-1, 10-2, 10-3 and 10-4 respectively while moving in traversing motion. When these packages are fully wound, the traversing means is moved away from the packages. This brings the strand 6-1 to a position 6-1*a* as it is regulated by the shoe 8-1. Then the guide 7 is moved from position a toward position d. As the guide 7 reaches a position b in its movement, the strand 6-1 is moved by the guide 7 to a position 6-1*b* in which the strand 6-1 drops into the groove between the packages 10-1 and 10-2 to produce a loose portion in the strand 6-1. At the same time, the strand 6-1 is brought into contact with the edge of the package 10-2 at a point e. Further movement of the guide 7 toward position d shifts the point of contact of the strand 6-1 with the edge of the package 10-2 from e to f and at the same time causes the strand 6-1 to overlie the outer layer of the package 10-2. Rotation of the spindle 3 while the strand 6-1 overlies the package 10-2 enables the strand 6-1 to negotiate the groove between the packages 10-1 and 10-2 and be wound on the surface of the package 10-2. The strand 6-1 that has been shifted and the strand 6-2 are collected by the guide 7 over the package 10-2, and drop into the groove between the packages 10-2 and 10-3 when the guide 7 reaches a position c. However, further movement of the guide 7 toward position d brings the strands 6-1 and 6-2 into contact with the edge of the package 10-3 and causes the strands to overlie the surface of the package 10-3. In this way, the strands are shifted while negotiating the grooves and passing over the packages, so that when the guide 7 reaches position d all the strands 6-1, 6-2, 6-3 and 6-4 complete their shifting to the front waste take-up portion 3-2 of the spindle 3 where they are wound.

From the foregoing description, it will be appreciated that the speed of travel of the guide 7 and the spacing between the path of travel of the guide 7 and the spindle 3 are important factors concerned in enabling the strand dropping into the groove to immediately be moved to a position in which it overlie the adjacent package.

We have conducted experiments on these factors and found that the optimum speed of travel of the guide 7 is 1.5 m/sec. We have also found that the spacing between the path of travel of the guide 7 and the spindle 3 is preferably determined such that the distance L between the point of contact of the strand dropping into the groove between the adjacent package with the spindle (or more strictly, the point of contact of the strand with the bobbin on the spindle) is less than 300 mm (See FIG. 4). When the position of the guide 7 was not in this range, or was in a position 7' as shown in FIG. 4, the strands dropped into the groove between the packages would only contact with the edge of the package at a point g and could not wind on the surface of the adjacent package, even if the guide 7 was moved toward position d. Thus the edge of the package was damaged and strand breakout occurred in most cases. When such phenomenon occurred, it was possible to let the strands safely negotiate the grooves and pass over the packages by increasing the speed of travel of the guide 7.

It has been ascertained by the results of the experiments that in effecting smooth shifting of the strands to the front end of the spindle when a plurality of square-ended packages are formed on a single spindle, the packages to be formed preferably have in general a width W of over 120 mm and an outer diameter $D_2$ of below 350 mm while the bobbin has an outer diameter $D_1$ of over 100 mm.

Tests were conducted on the rate of success in transferring strands by varying the spacing L between the guide 7 and the point of contact of the strands with the bobbin, in winding four packages and two packages. The results obtained are shown below.

Winding of Four Packages

| Spacing L between the Point of Contact of Strands with Bobbin and Guide (mm) | Rate of Success (%) |
|---|---|
| 250 | 100 |
| 300 | 100 |
| 350 | 95 |
| 400 | 20 |
| 450 | 0 |
| Speed of Travel of Guide | 1.5 m/sec |
| Outer Diameter of Bobbin $D_1$ | 150 mm |
| Outer Diameter of Package $D_2$ | 320 mm |
| Width of Package W | 120 mm |
| Width of Groove between Packages | 13 mm |
| Winding Speed | 800 m/min |

Winding of Two Packages

| Spacing L between the Point of Contact of Strands with Bobbin and Guide (mm) | Rate of Success (%) |
|---|---|
| 250 | 100 |
| 300 | 100 |
| 350 | 95 |
| 400 | 50 |
| Outer Diameter of Package $D_2$ | 300 mm |
| Width of Package W | 250 mm |
| Width of Groove between Packages | 15 mm |

(Speed of travel of guide, outer diameter of bobbin and winding speed were the same as in winding of four -continued

| Winding of Two Packages | |
|---|---|
| Spacing L between the Point of Contact of Strands with Bobbin and Guide (mm) | Rate of Success (%) |
| packages.) | |

From the results of the experiments shown hereinabove, it will be appreciated that by setting the spacing between the path of travel of the guide and the spindle at an optimum value and moving the guide at an optimum speed of travel, the strands dropping into the groove between the packages and producing loose portions can be immediately brought into contact with the edge and surface of the adjacent package, and the strands dropping into the groove can be immediately moved to the surface of the adjacent package by the force of friction between the strands and the package and the rotational force of the spindle. In this way, the strands can be shifted to the front end of a fully wound spindle by negotiating the grooves and passing over the packages, thereby making continuous winding of glass fiber possible.

Thus as shown in the table below, the embdiment of the invention described hereinabove for shifting strands to enable continuous winding of the glass fiber can achieve higher operation efficiency and increased productivity as compared with a method of the prior art wherein winding of the glass fiber is interrupted when a spindle is fully wound.

| | Operation Efficiency (%) | |
|---|---|---|
| | Two Packages of 250 mm Wide | Four Packages of 120 mm Wide |
| Method of the Embodiment | 88 | 84 |
| Method of the Prior Art | 77 | 70 |

Note: The glass fiber drawn was 1,400 g/min (4,000 holes).

In the embodiment shown and described hereinabove, the strands temporarily drop into the groove between the adjacent packages and then are brought into contact with the peripheral surface of the adjacent package so as to negotiate the groove and pass over the package. The results of the experiments have further revealed that by further increasing the speed of travel of the guide 7, the strands can be directly shifted from package to package without dropping into the grooves between the packages and can be brought into contact with the surface of the adjacent package. An embodiment which makes this possible will be described by referring to FIGS. 6 and 7.

Figure 6:
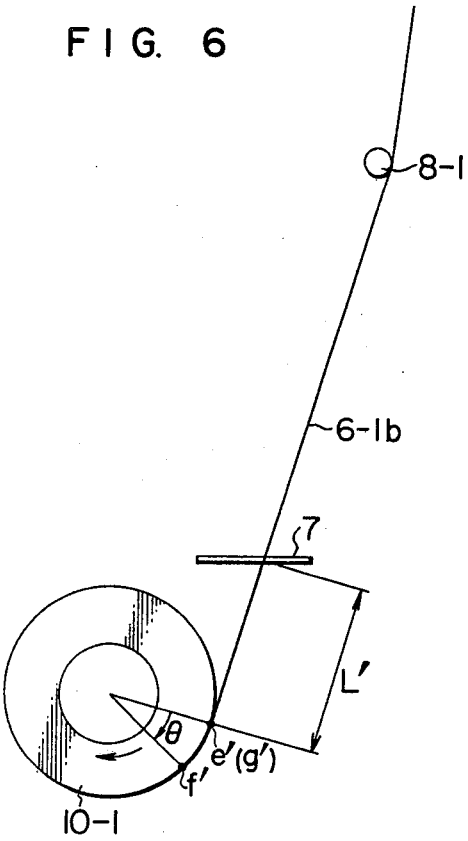
FIGS. 6–8 are views in explanation of the manner in which the strands shift their positions by negotiating the groove between the adjacent packages according to a modification of the method of the invention, FIG. 6 being a schematic side view of the spindle, FIG. 7 being a front view thereof and FIG. 8 being a view showing the essential portions of FIG. 7 on an enlarged scale and showing the packages by developing them.
Figure 7:
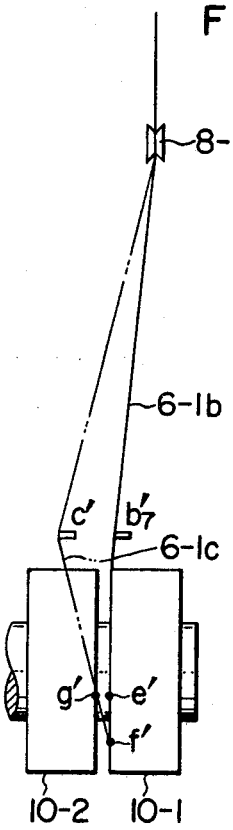

FIGS. 6 and 7 show shifting of a strand from one package to another by means of the guide 7. To simplify explanation, the guide 7 is disposed in position b' and the strand is wound on the end portion of one package 10-1 at the beginning. The strand 6-1*b* guided by the guide 7 in position b' is in contact with the package 10-1 at a point e'. As the guide 7 moves from position b' to position c', the package 10-1 rotates through an angle $\theta$ and point e' on the package 10-1 moves to a point f', so that the strand shifts from 6-1*b* to 6-1*c*. The strand at 6-1*c* contacts the adjacent package 10-2 at a point g'. As the guide 7 further moves beyond position c' and the packages further rotate, the strand contacting the edge of the package 10-2 at point g' would be wound on the package 10-2 if there were no slip between the strand and the edge of the package. Research conducted by us has shown that when the speed of travel of the guide 7, the distance between the guide 7 and the point e' at which the strand is in contact with the package and the outer diameter of the packages meet the predetermined requirements, it is possible to avoid slipping of the strand on the package and enable the former to be brought into contact with the latter. These requirements will be discussed by referring to FIG. 8.

Figure 8:
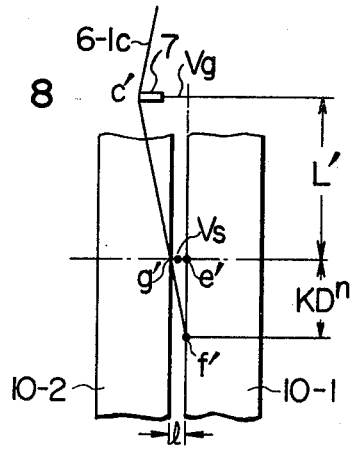

FIG. 8 shows the guide 7 in position c' with the surface of the packages being developed. In the discussion, the following notations will be used.

V: Winding speed.

Vs: Speed of movement of strand on package.

Vg: Speed of travel of guide.

l: Width of groove between packages.

D: Outer diameter of packages.

L': Distance between guide and point of contact of strand with package.

In FIG. 8, the following relation holds:

$$\frac{Vs}{V} = \frac{l}{\text{distance between } e' \text{ and } f'} \tag{1}$$

In order that the strand 6-1*c* may not slip at a point g', it is essential that the distance between e' and f' and the angle $\theta$ (See FIG. 6) be small. The maximum value of the distance between e' and f' which is necessary for avoiding the occurrence of slip at point g' is a function of the diameter D of the package. If this value is denoted by $KD^n$ (where K and n are constants), the following relation will hold:

$$\frac{Vs}{V} > \frac{l}{KD^n} \tag{2}$$

$$\text{Therefore, } Vs > \frac{Vl}{KD^n}$$

Meanwhile the relation between Vs and Vg can be expressed by the following equation, as is clear in FIG. 6:

$$Vs:Vg = KD^n:KD^n + L' \tag{3}$$

$$\text{Therefore, } Vg = \frac{Vs(KD^n + L')}{KD^n} \tag{4}$$

By substituting equation (2) into equation (4), we get the following:

$$Vg > \frac{Vl(KD^n + L')}{(KD^n)^2} \tag{5}$$

$$= Vl\left(\frac{D^{-2n}}{K^2}L' + \frac{D^{-n}}{K}\right)$$

In equation (5), K and n are constants. Tests were conducted on shifting of the strands under various conditions. As a result, the following values were obtained:

$$K=0.231,\ n=0.4$$

By substituting these values into equation (5), we get the following equation:

$$Vg > Vl(18.7D^{-0.8}L' + 4.3D^{-0.4}) \quad (6)$$

Thus it will be evident that if shifting of the strand is effected under conditions which satisfy equation (6), it will be possible to cause the strand to move smoothly across the groove between the packages without dropping thereinto.

As is clear from equation (6), the value of Vg will be small if the diameter of the package D is large or the values of V, l and L' are small, thereby facilitating transfer of the strand from one package to another.

As the results of the tests, it has also been ascertained that in order to enable the strand to move smoothly from package to package without dropping into the groove when winding a plurality of square-ended packages on a single spindle, there are other conditions that are preferably satisfied in addition to the requirements indicated by the equation (6). These conditions are as follows:

| | |
|---|---|
| Outer Diameter of Bobbin | over 100 mm |
| Width of Packages | over 120 mm |
| Outer Diameter of Packages | below 350 |
| Distance between Guide and Point of Contact of Strand with Bobbin | below 250 mm |

Tests were conducted on the rate of success in transferring strands by varying the spacing L' between the guide 7 and the point of contact of the strand with the package, in winding four packages and two packages. The results obtained are shown below:

| Winding of Four Packages | |
|---|---|
| L' (mm) | Rate of Success (%) |
| 200 | 100 |
| 250 | 100 |
| 260 | 97 |
| 270 | 94 |
| 280 | 91 |
| 290 | 88 |
| 300 | 85 |
| 350 | 30 |
| 400 | 10 |
| Speed of Travel of Guide | Vg = 3 m/sec |
| Outer Diameter of Bobbin | 150 mm |
| Outer Diameter of Package | D = 350 mm |
| Width of Package | 120 mm |
| Width of Groove between Packages | l = 13 mm |
| Winding Speed | V = 800 m/min |

| Winding of Two Packages | |
|---|---|
| L' (mm) | Rate of Success (%) |
| 200 | 100 |
| 250 | 100 |
| 260 | 98 |
| 270 | 98 |
| 280 | 95 |
| 290 | 95 |
| 300 | 95 |
| 350 | 90 |
| 400 | 50 |
| Speed of Travel of Guide | Vg = 4 m/sec |
| Outer Diameter of Bobbin | 150 mm |
| Outer Diameter of Package | D = 280 mm |
| Width of Package | 120 mm |
| Width of Groove between Packages | l = 15 mm |

-continued

| Winding of Two Packages | |
|---|---|
| L' (mm) | Rate of Success (%) |
| Winding Speed | V = 800 m/min |

From the foregoing description, it will be appreciated that in this embodiment the strand can be brought into contact with the edge and surface of the adjacent package without dropping into the groove between the packages to enable the strand to move to the surface of the adjacent package by the force of friction acting between the strand and package and the rotational force of the spindle, if the guide is moved at an optimum speed of travel as described hereinabove. By repeating this process, continuous winding of the glass fiber can be made possible when a plurality of square-ended packages are wound on a single spindle.

Thus it will be seen in the table below that the method according to the invention can achieve a higher operation efficiency and productivity than a method of the prior art wherein operation of the spindle is interrupted when fully wound. And the invention has raised operation efficiency in forming square-ended packages to the same level as that in forming double-tapered packages.

| | Operation Efficiency (%) | |
|---|---|---|
| | Two Packages of 250 mm Width | Four Packages of 120 mm Width |
| Method of the Embodiment | 88 | 88 |
| Method of the Prior Art | 81 | 77 |

Note: The glass fiber drawn was 900 g/min (2,000 holes).

What is claimed is:

1. In a method of drawing a multiplicity of glass filaments from a glass melting furnace, dividing them into a plurality of strands and winding on a single spindle having a waste take-up portion adjacent to a free end thereof to form a plurality of square-ended packages thereon, a method of shifting strands from said packages to said waste take-up portion while continuing rotation of the spindle, characterized by the step of moving a guide from a position adjacent to a supported end of the spindle toward said free end along a path substantially parallel to and adjacent to said spindle so that the guide successively engages, collects and shifts the strands which are running toward the spindle, and the step of setting the spacing between said path and spindle to be sufficiently little and setting the speed of travel of said guide to be sufficiently high to enable the strand to be shifted from a peripheral surface of a package to a peripheral surface of an adjacent package without dropping into a groove formed between the adjacent packages.

2. A method as claimed in claim 1, which includes setting wherein the speed of travel of the guide at a level which is obtained by the following formula:

$$Vg > Vl(18.7D^{-0.8}L' + 4.3D^{-0.4})$$

where

Vg: Speed of travel of guide

V: Winding speed l: Width of groove between packages

D: Outer diameter of package

L': Distance between the point of contact of strand with package and guide so that the strands can be shifted to the adjacent package without dropping into the groove between the adjacent packages.

* * * * *

UNITED STATES PATENT AND TRADEMARK OFFICE

CERTIFICATE OF CORRECTION

PATENT NO. : 4,342,430

DATED : August 3, 1982

INVENTOR(S) : Sin Kasai; Yutaka Kawaguchi; Michio Satoh

It is certified that error appears in the above-identified patent and that said Letters Patent are hereby corrected as shown below:

Column 10, line 54 for "setting wherein the speed" read--setting the speed--.

Signed and Sealed this

*Twenty-second* Day of *February 1983*

[SEAL]

*Attest:*

GERALD J. MOSSINGHOFF

*Attesting Officer*

*Commissioner of Patents and Trademarks*